US008226225B2

(12) United States Patent
Yamanobe

(10) Patent No.: US 8,226,225 B2
(45) Date of Patent: Jul. 24, 2012

(54) INKJET RECORDING APPARATUS AND INKJET RECORDING METHOD

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1061 days.

(21) Appl. No.: 11/889,550

(22) Filed: Aug. 14, 2007

(65) Prior Publication Data

US 2008/0055356 A1 Mar. 6, 2008

(30) Foreign Application Priority Data

Sep. 1, 2006 (JP) ..... 2006-238071

(51) Int. Cl.
*B41J 2/01* (2006.01)

(52) U.S. Cl. ..... 347/103; 347/100; 347/21

(58) Field of Classification Search ..... 347/100
See application file for complete search history.

(56) References Cited

U.S. PATENT DOCUMENTS 5,365,261 A * 11/1994 Ozawa et al. ..... 347/103
2005/0212884 A1 9/2005 Ueki et al.
2006/0055755 A1 3/2006 Yui
2006/0170752 A1 * 8/2006 Kadomatsu et al. ..... 347/105
2006/0238592 A1 * 10/2006 Kadomatsu et al. ..... 347/102

FOREIGN PATENT DOCUMENTS

JP 6-126945 A 5/1994
JP 2005-161610 A 6/2005
JP 2005161610 A * 6/2005
JP 2005-271401 * 10/2005
JP 2005-271401 A 10/2005
JP 2005271401 A * 10/2005
JP 2006-82428 A 3/2006
JP 2006-205677 A 8/2006
JP 2006205677 A * 8/2006

* cited by examiner

*Primary Examiner* — Uyen Chau N Le
*Assistant Examiner* — Hoang Tran
(74) *Attorney, Agent, or Firm* — Birch, Stewart, Kolasch & Birch, LLP

(57) ABSTRACT

The inkjet recording apparatus has: an ink droplet ejection device which ejects a droplet of an ink containing a coloring material; a treatment liquid deposition device which deposits a treatment liquid that causes the coloring material contained in the ink to aggregate so as to create a coloring material aggregate; and an absorbing body which absorbs a solvent of a mixed liquid including the ink ejected as the droplet by the ink droplet ejection device and the treatment liquid deposited by the treatment liquid deposition device, wherein solvent absorption holes having an opening diameter larger than a spreading width of the coloring material aggregate in the mixed liquid on a surface of a recording body are formed in a surface of the absorbing body.

18 Claims, 14 Drawing Sheets

INKJET RECORDING APPARATUS AND INKJET RECORDING METHOD

BACKGROUND OF THE INVENTION

1. Field of the Invention

The present invention relates to an inkjet recording apparatus, and more particularly, to an inkjet recording apparatus which is capable of inkjet printing of high quality by improving the solvent absorption rate by means of an absorbing body.

2. Description of the Related Art

In high-quality inkjet printing, if wrinkling ("called cockling") of the paper occurs as a result of a deposited solvent permeating into the paper, then the print quality declines markedly. In response to this problem, there is a known method which evaporates (dries) the solvent by means of heating, but this method requires a large load of energy, and may lead to instability of the system (for example, liquid droplet ejection failures as a result of the ink drying in the nozzle sections).

In response to this, Japanese Patent Application Publication No. 2005-161610, Japanese Patent Application Publication No. 2005-271401 and Japanese Patent Application Publication No. 2006-82428 disclose solvent removal methods based on contact-based absorption of the solvent by means of an absorbing body (below, this is called "solvent absorption").

In Japanese Patent Application Publication No. 2005-161610, solvent absorption is carried out by means of a porous body having a capillary portion, and by making the diameter of the pores of the porous body smaller than the diameter of the particles of the coloring material, the coloring material is prevented from entering inside the absorbing body and only the solvent is absorbed by the absorbing body.

In Japanese Patent Application Publication No. 2005-271401, solvent absorption is carried out by means of a porous body having a capillary portion, and by using an absorbing body having a collection rate (ratio of trapped particles) of 90% or greater when filtering particles having an average particle size of 5 μm, the coloring material is prevented from entering into the absorbing body and only the solvent is absorbed by the absorbing body.

In Japanese Patent Application Publication No. 2006-82428, a fiber material is used as an absorbing body, and by making the thickness of the fibers 0.01 to 100 dtex, then only the solvent is recovered, while retaining fiber strength.

In Japanese Patent Application Publication No. 2005-161610, Japanese Patent Application Publication No. 2005-271401 and Japanese Patent Application Publication No. 2006-82428, the holes formed in the contact portion of the surface of the absorbing body are formed to have a small opening diameter so that the coloring material does not enter into the absorbing body; however, if this technique is applied to a case where a coloring material aggregate is formed by causing the ink to react with a treatment liquid so that the coloring material in the ink aggregates, then situations may arise where the coloring material aggregate becomes blocked in the holes of the absorbing material, and hence there is a possibility that the absorption rates of the treatment liquid and the ink solvent (the solvent absorption rate) may decline dramatically, causing marked deterioration of the print quality.

SUMMARY OF THE INVENTION

The present invention has been contrived in view of the aforementioned circumstances, an object thereof being to provide an inkjet recording apparatus which is capable of high quality printing by raising the solvent absorption rate achieved by an absorbing body.

In order to attain the aforementioned object, the present invention is directed to an inkjet recording apparatus comprising: an ink droplet ejection device which ejects a droplet of an ink containing a coloring material; a treatment liquid deposition device which deposits a treatment liquid that causes the coloring material contained in the ink to aggregate so as to create a coloring material aggregate; and an absorbing body which absorbs a solvent of a mixed liquid including the ink ejected as the droplet by the ink droplet ejection device and the treatment liquid deposited by the treatment liquid deposition device, wherein solvent absorption holes having an opening diameter larger than a spreading width of the coloring material aggregate in the mixed liquid on a surface of a recording body are formed in a surface of the absorbing body.

In this aspect of the present invention, since the opening diameter of the solvent absorption holes formed in the surface of the absorbing body is greater than the spreading width of the coloring material aggregate generated in the mixed liquid of the ink and treatment liquid, then it is possible to absorb the solvent of the mixed liquid via the periphery of the coloring material aggregate, by means of capillary action. Furthermore, since the coloring material aggregate is provisionally fixed on the recording body (e.g., the intermediate transfer body or the recording medium) and is not therefore absorbed into the absorbing body, then situations where the coloring material aggregate blocks up the solvent absorption holes are avoided. As a result of the foregoing effects, it is possible to improve the solvent absorption efficiency of the absorbing body.

Here, the maximum width of the planar region occupied by the coloring material aggregate spreading on the surface of the recording body (e.g., the intermediate transfer body or the recording medium) when the aggregation reaction of the coloring material in the mixed liquid has ended, is regarded as the spreading width of the coloring material aggregate.

The "recording body" indicates a medium which receives the recording of an image (this medium may also be called a print medium, image forming medium, image receiving medium, or the like). This term includes various types of media, irrespective of material and size, such as continuous paper, cut paper, sealed paper, resin sheets such as OHP sheets, film, cloth, a printed circuit board, cardboard, metal plate, or the like.

Preferably, the opening diameter of the solvent absorption holes is smaller than a spreading width of the solvent of the mixed liquid on the surface of the recording body at time that the absorbing body makes contact with the mixed liquid.

In this aspect of the present invention, if the absorbing body is moved to close proximity with the recording body (e.g., the intermediate transfer body or the recording medium), then the mixed liquid always makes contact with the peripheral region of the solvent absorption hole of the absorbing body, and therefore it is possible to take up the solvent of the mixed liquid via the solvent absorption holes of the absorbing body and hence to absorb the solvent in a reliable fashion.

Here, the minimum width of the planar region occupied by the mixed liquid spreading on the surface of the recording body (e.g., the intermediate transfer body or the recording medium) at the time that the absorbing body makes contact with the mixed liquid after the aggregation reaction of the coloring material has ended on the surface of the recording body, is regarded as the spreading width of the solvent of the mixed liquid.

Preferably, the droplet of the ink is ejected by the ink droplet ejection device after the treatment liquid is deposited by the treatment liquid deposition device.

In this aspect of the present invention, it is possible to suppress bleeding and landing interference of the ink.

Preferably, the recording body is an intermediate transfer body on which the coloring material aggregate in the mixed liquid forms an image being transferred to a recording medium from the intermediate transfer body; and the absorbing body absorbs the solvent of the mixed liquid on the intermediate transfer body.

In this aspect of the present invention, since the solvent is absorbed by the absorbing body from the mixed liquid generated on the intermediate transfer body, prior to the transfer of the image to the recording medium, then it is possible to avoid situations where the solvent permeates into the recording medium to which the image is transferred, and therefore printing of high quality can be achieved.

Furthermore, by selecting an intermediate transfer body which guarantees large adhesion energy with respect to the coloring material aggregate, the solvent is absorbed reliably by the absorbing body from the mixed liquid generated on the intermediate transfer body, and therefore it is possible to achieve high-quality printing, regardless of the type of recording medium.

In order to attain the aforementioned object, the present invention is also directed to an inkjet recording method comprising the steps of: depositing a treatment liquid which causes a coloring material contained in ink to aggregate so as to create a coloring material aggregate, onto a recording body; ejecting a droplet of the ink containing the coloring material onto the recording body; generating a mixed liquid in which the coloring material aggregate is created from the deposited treatment liquid and the ejected droplet of the ink, on a surface of the recording body; and absorbing a solvent of the mixed liquid by means of an absorbing body having a surface in which solvent absorption holes having an opening diameter larger than a spreading width of the coloring material aggregate in the mixed liquid are formed.

According to the present invention, it is possible to achieve high-quality printing by improving the solvent absorption rate achieved by an absorbing body.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
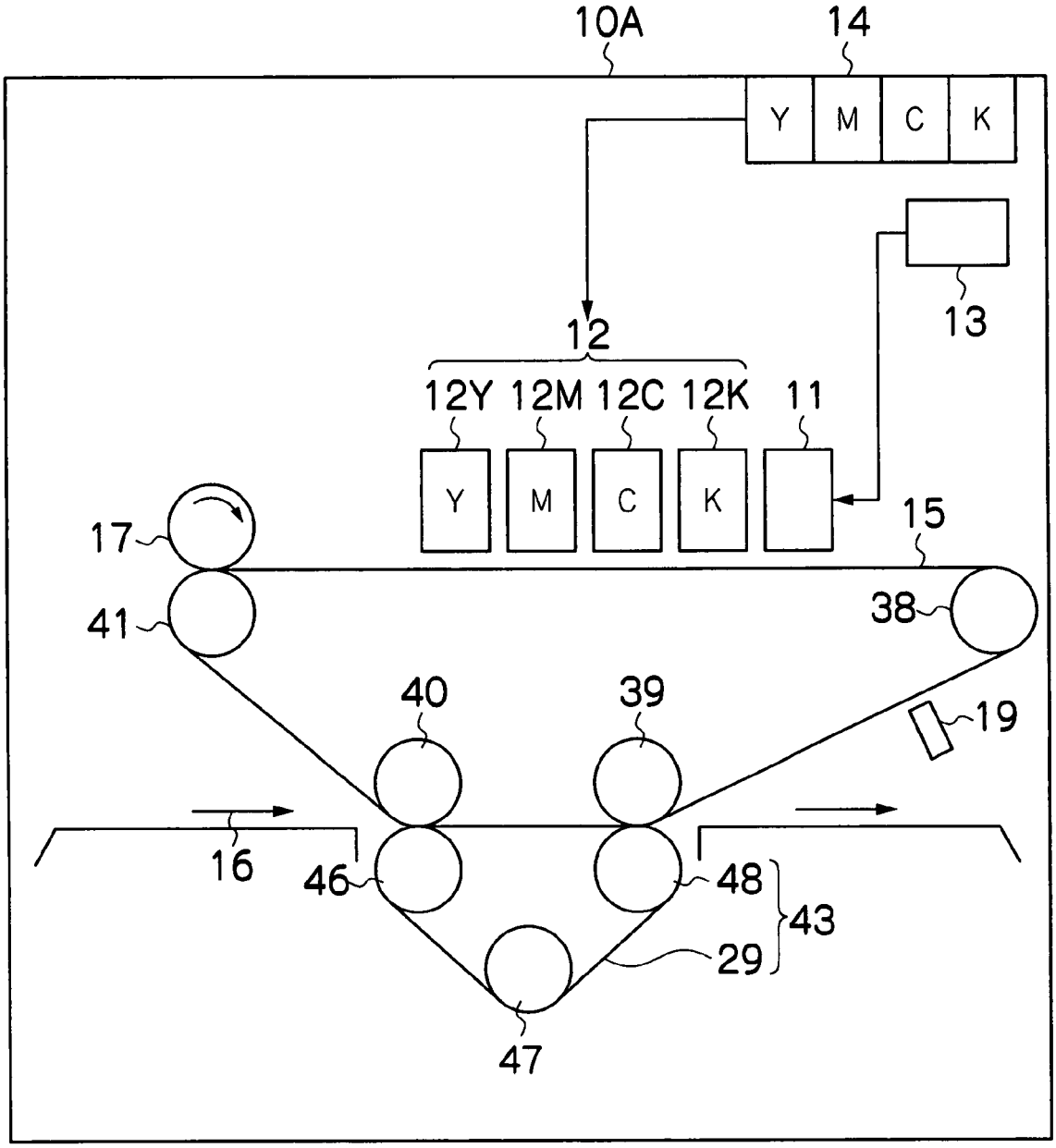
FIG. 1 is a general compositional view showing an approximate view of an intermediate transfer body type of inkjet recording apparatus using an inkjet head relating to one embodiment of the present invention.

FIG. 1 is a general schematic drawing of an intermediate transfer type of an inkjet recording apparatus which is one embodiment of an inkjet recording apparatus relating to the present invention. As shown in FIG. 1, this inkjet recording apparatus 10A comprises an inkjet recording head (hereinafter, called "head") 11 which is provided to correspond to a treatment liquid 28 which does not contain coloring material, and a print unit 12 having a plurality of ink heads 12K, 12C, 12M and 12Y provided to correspond to respective inks 27 (first liquid) which contain respective coloring materials of black (K), cyan (C), magenta (M) and yellow (Y). Furthermore, an absorbing body 17 for absorbing the solvent is provided. Moreover, an endless intermediate transfer body 15 which is spanned about a plurality of rollers (38 to 41) is also provided. A transfer body cleaning unit 19 is provided as a cleaning device for the intermediate transfer body 15.

Two types of liquid, namely, the treatment liquid 28 and inks 27 of different colors are respectively ejected from the treatment liquid head 11 and the ink heads 12K, 12C, 12M and 12Y, thereby generating a mixed liquid in which a coloring material aggregate 21 is created on the intermediate transfer body 15. The solvent 23 of the mixed liquid is absorbed by the absorbing body 17 and an image is formed by the coloring material aggregate 21 on the intermediate transfer body 15, whereupon the image is transferred from the intermediate transfer body 15 to the recording paper 16.

Figure 2:
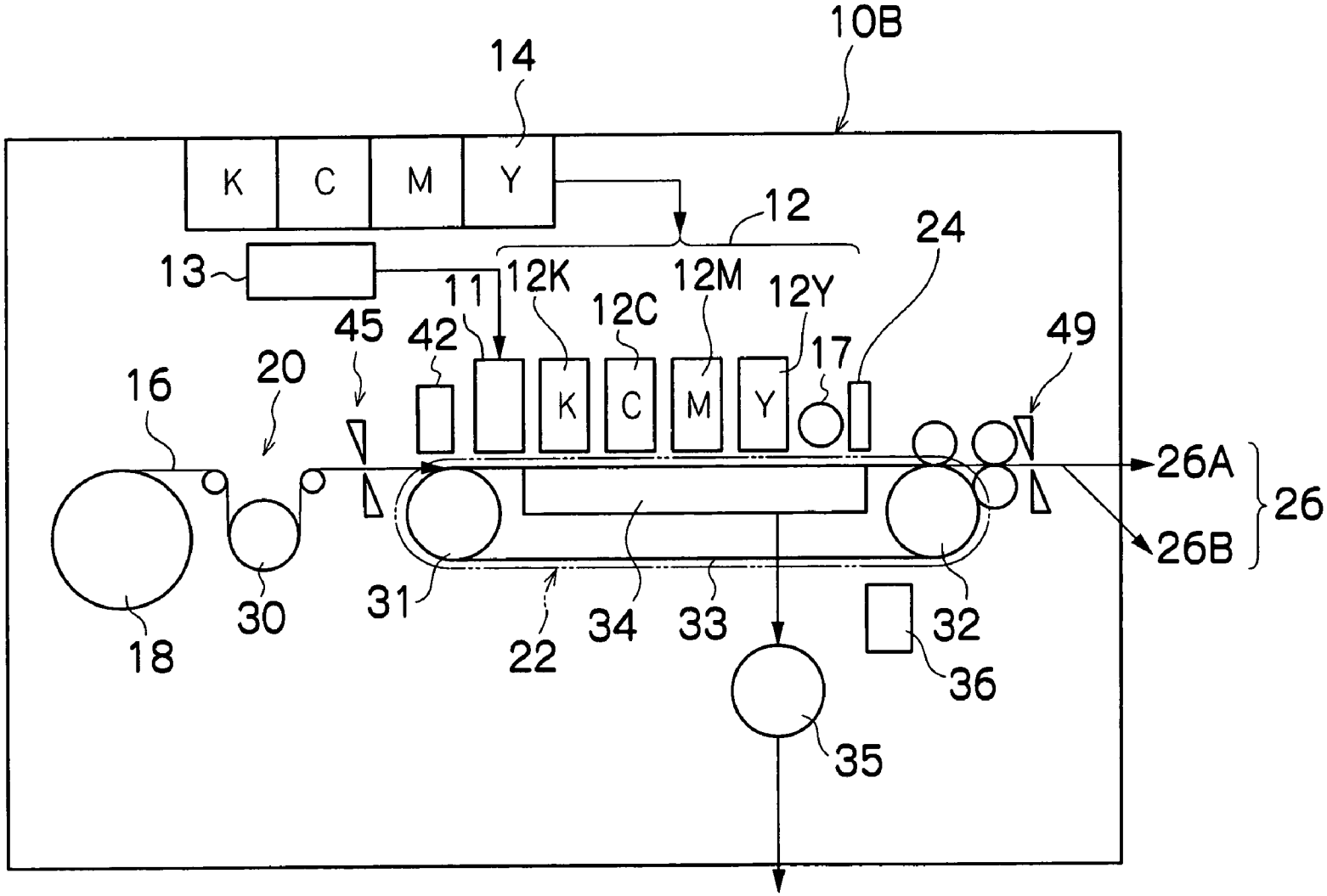
FIG. 2 is a general compositional view showing an approximate view of a direct transfer type of inkjet recording apparatus using an inkjet head relating to one embodiment of the present invention.

Furthermore, FIG. 2 is a general schematic drawing of a direct printing type of inkjet recording apparatus showing a further embodiment of an inkjet recording apparatus relating to the present invention. As shown in FIG. 2, in this inkjet recording apparatus 10B, the treatment liquid head 11, the print unit 12 and the absorbing body 17 are the same as those of the intermediate transfer type of inkjet recording apparatus 10A described above, but the inkjet recording apparatus 10B is different in that it does not comprises the intermediate transfer body 15, but rather comprises a belt conveyance unit 22 which conveys the recording paper 16 while keeping the recording paper flat and which is disposed facing the nozzle surface of the print unit 12 (ink ejection surface).

Two types of liquid, namely, the treatment liquid 28 and the inks 27 of different colors are respectively ejected from the treatment liquid head 11 and the ink heads 12K, 12C, 12M and 12Y while the recording paper 16 is conveyed by the belt conveyance unit 22, thereby generating a mixed liquid comprising the coloring material aggregate 21 and the solvent 23, on the recording paper 16. The solvent 23 of the mixed liquid is absorbed by the absorbing body 17 and an image is formed by the coloring material aggregate 21 on the recording paper 16.

A further detailed description of the general composition of the inkjet recording apparatus is given below.

Description of Absorbing Body

Figure 3:
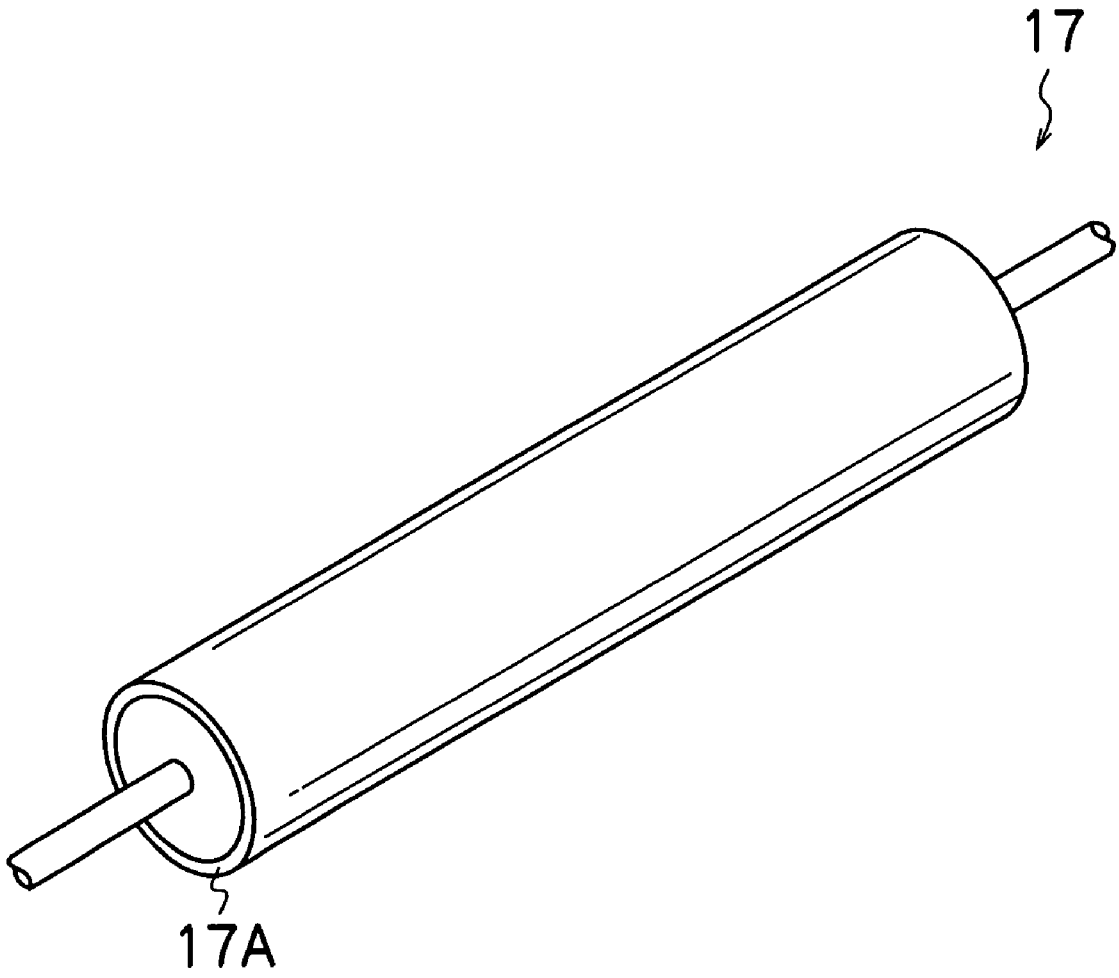
FIG. 3 is an external view of an absorbing body.
Figure 4A:
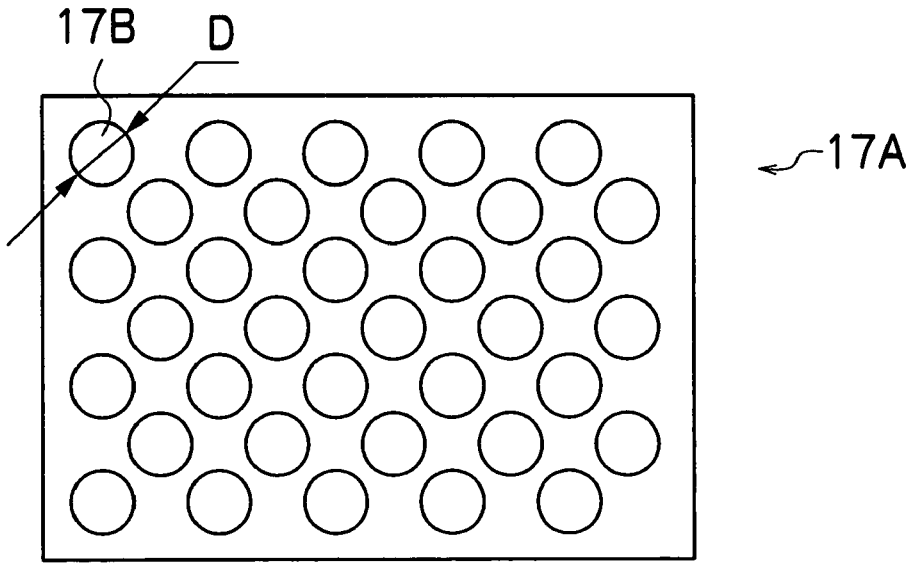
FIGS. 4A and 4B are expanded diagrams (enlarged diagrams) of the contact section of the absorbing body.
Figure 4B:
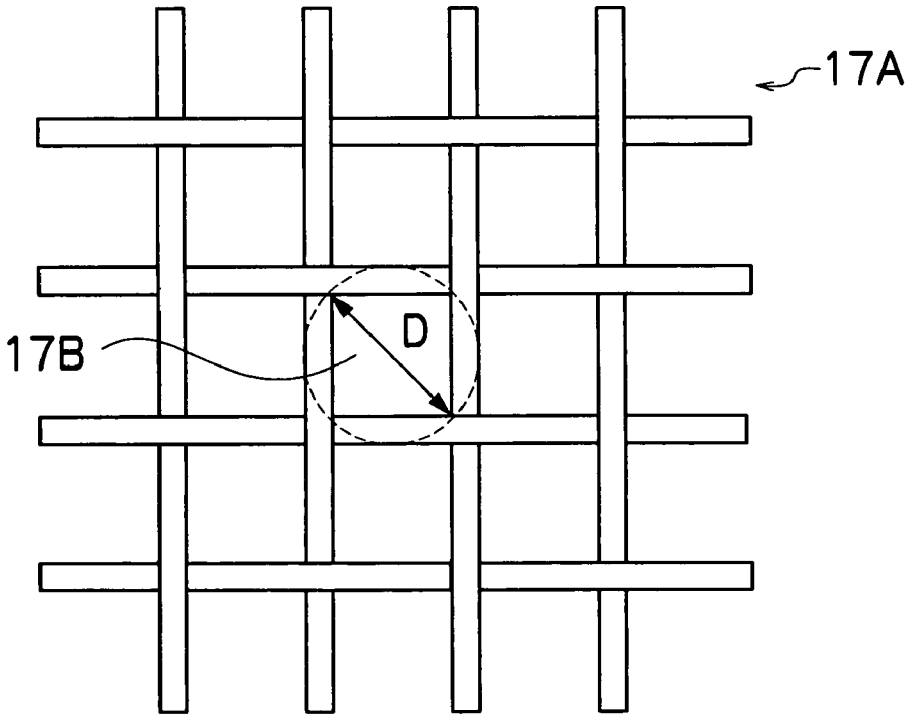

FIG. 3 is an external view of the absorbing body 17 according to an embodiment of the present invention. As shown in FIG. 3, the absorbing body 17 has a round cylindrical shape, and a contact section 17A which comprises solvent absorption holes 17B (see FIGS. 4A and 4B) is formed on the surface of the round cylindrical shape. FIGS. 4A and 4B are expanded diagrams (enlarged diagrams) showing two examples of this contact section 17A. FIG. 4A shows an example where round holes are formed at equidistant intervals, and FIG. 4B shows an example where holes are formed in a mesh configuration.

Figure 5:
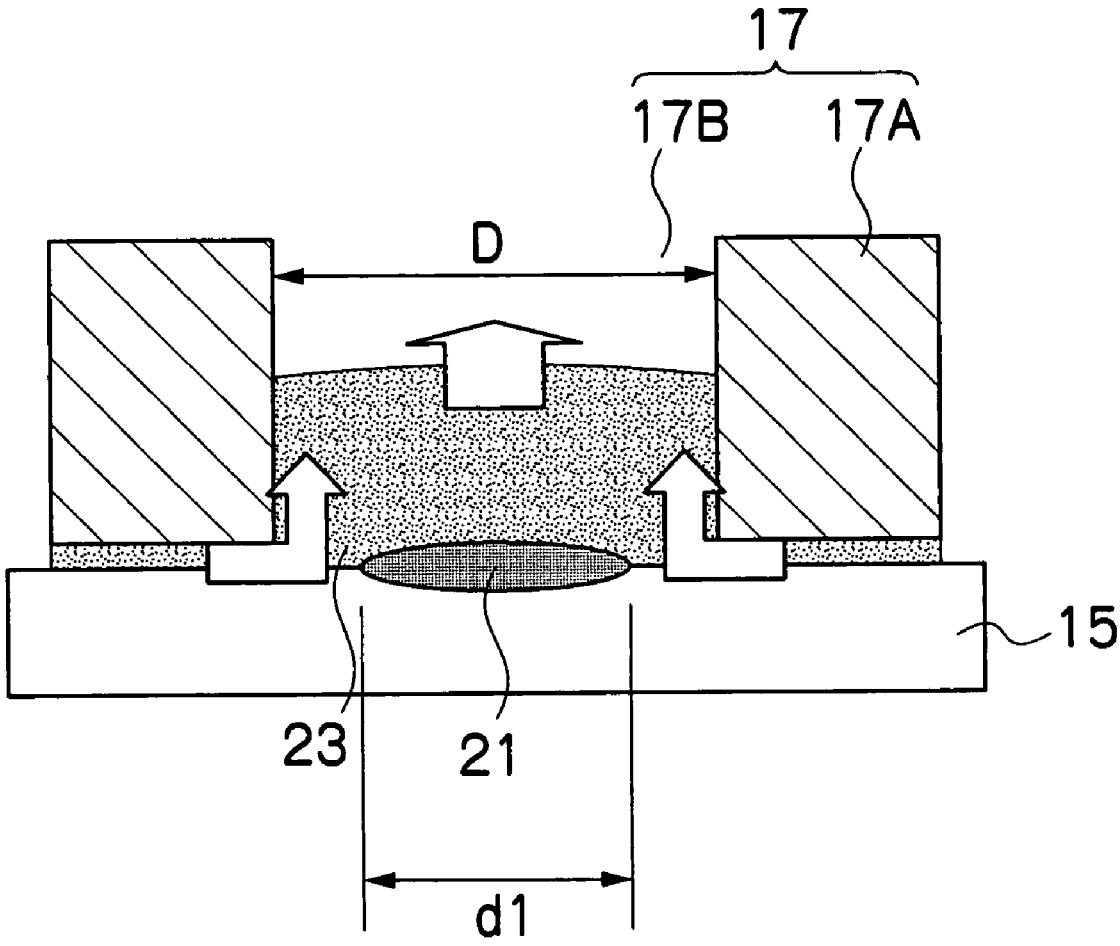
FIG. 5 is a cross-sectional diagram of a portion of a solvent absorption hole formed in the contact section of the absorbing body.

FIG. 5 is a cross-sectional diagram of a portion of a solvent absorption hole 17B formed with contact sections 17A of the absorbing body 17. As shown in FIG. 5, the opening diameter D of the solvent absorption hole 17B is formed to be greater than the diameter d1 which is the spreading width of the substantially round-shaped coloring material aggregate 21 generated in the mixed liquid in one dot formed by the ejected ink 27 and treatment liquid 28. Consequently, the coloring material aggregate 21 does not cover the whole of the solvent absorption hole 17B, and the solvent 23 is absorbed by capillary action from the periphery of the coloring material aggregate 21.

Furthermore, since the coloring material aggregate 21 thus formed has a greater specific weight than the solvent 23, and since it is not dissolved (or dispersed) in the solvent 23, then close adhesion is achieved between the coloring material aggregate 21 and the intermediate transfer body 15 (or the recording paper 16), and the coloring material aggregate 21 becomes temporarily fixed on the intermediate transfer body 15 (or recording paper 16). Consequently, the coloring material aggregate 21 is not absorbed by the absorbing body 17. Therefore, while the solvent 23 is absorbed reliably by the absorbing body 17, it is possible to prevent the coloring material aggregate 21 from blocking up the solvent absorption holes 17B, so that the decline in the absorption efficiency is prevented.

Figure 6A:
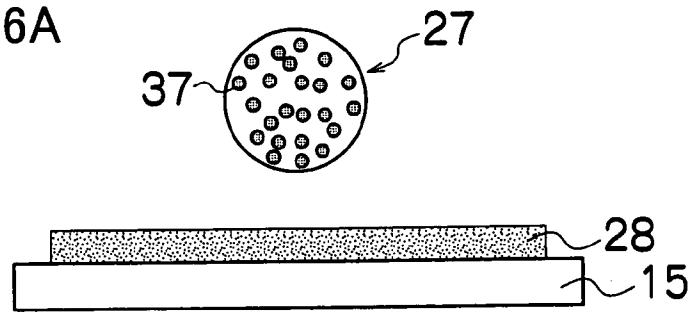
FIGS. 6A to 6F are diagrams showing a sequence of actions for forming a coloring material aggregate by ejecting droplets of the ink and treatment liquid, and then performing solvent removal.
Figure 6B:
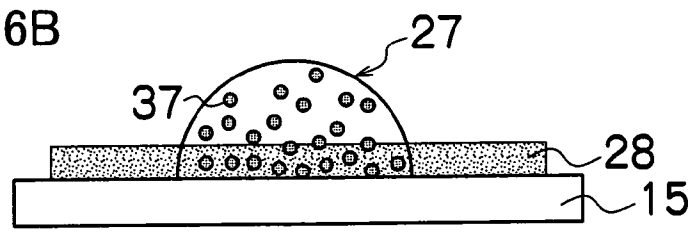
Figure 6C:
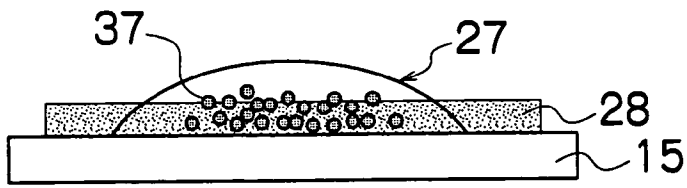
Figure 6D:
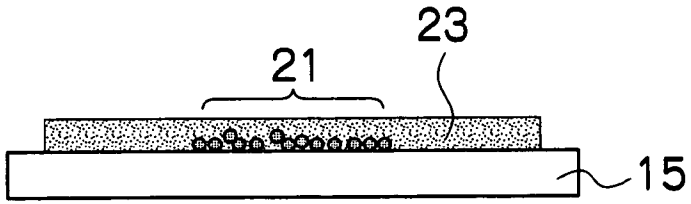

Here, the sequence of actions for ejecting droplets of the ink 27 and treatment liquid 28 to generate the mixed liquid in which a coloring material aggregate 21 arises and then removing the solvent 23 of the mixed liquid, is described below with reference to FIGS. 6A to 6F. As shown in FIG. 6A, after ejecting droplets of the treatment liquid 28 onto the intermediate transfer body 15 (or the recording paper 16), droplets of the ink 27 containing the coloring material 37 are ejected. When the ink 27 lands on the intermediate transfer body 15 (or recording paper 16) as shown in FIG. 6B, then as shown in FIG. 6C, an aggregate reaction of the coloring material 37 in the ink 27 proceeds due to the action of the treatment liquid 28, and furthermore, the solvent of the ink 27 mixes with the solvent of the treatment liquid 28. Thereupon, as shown in FIG. 6D, the aggregating reaction of the coloring material 37 ends, and the mixed liquid including the solvent 23 and coloring material aggregate 21 is generated on the intermediate transfer body 15 (or the recording paper 16).

Figure 6E:
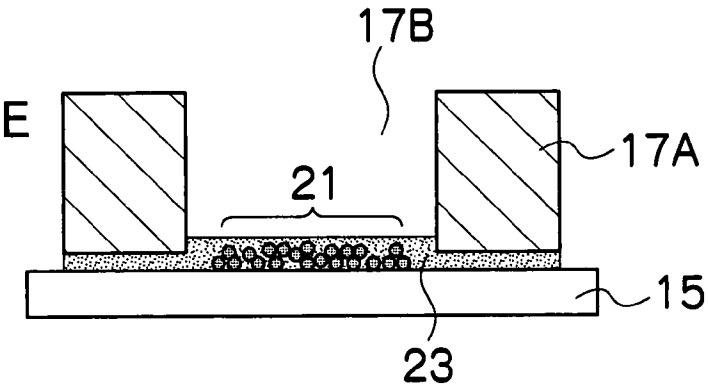

Thereupon, as shown in FIG. 6E, the absorbing body 17 is brought into proximity with the intermediate transfer body 15 (or the recording paper 16), the contact section 17A of the absorbing body 17 makes contact with the solvent 23 and the solvent 23 is absorbed and removed into the solvent absorption holes 17B. From the viewpoint that the solvent 23 is removed completely, it is desirable that the contact section 17A of the absorbing body 17 should make contact with the intermediate transfer body 15 (or the recording paper 16).

Figure 6F:
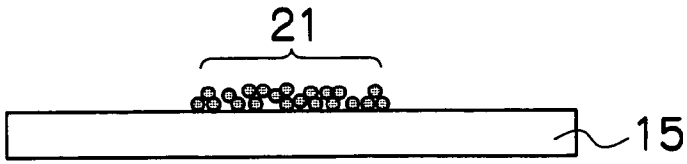

By means of the foregoing steps, only coloring material aggregate 21 is left on the intermediate transfer body 15 (or the recording paper 16), as shown in FIG. 6F, thereby forming an image.

In the present embodiment, the diameter d1 indicating the spreading width of the coloring material aggregate 21 in the mixed liquid on the surface of the intermediate transfer body 15 (or the recording paper 16) is the width supposing that the coloring material aggregate 21 has assumed a substantially round shape at the time that the aggregation reaction of the coloring material 37 ends. However, since the shape of the coloring material aggregate 21 is not limited to being a substantially round shape, then the spreading width of the coloring material aggregate 21 in the mixed liquid on the surface of the intermediate transfer body 15 (or the recording paper 16) is taken to be the maximum width of the planar region occupied by the coloring material aggregate 21 spreading in the mixed liquid, at the end of the aggregating reaction of the coloring material 37 on the surface of the intermediate transfer body 15 (or the recording paper 16).

Therefore, if the shape of the planar region in which the coloring material aggregate 21 has spread is substantially elliptical, then the longer diameter is regarded as the spreading width, and if it has a shape which cannot be specified as substantially circular or substantially elliptical, then the maximum width thereof is regarded as the spreading width.

Moreover, the coloring material aggregate 21 is formed in units of one dot of ink 27, and there is no aggregation between coloring material aggregates 21 belonging to different dots of ink 27. Therefore, it is possible to prevent decline in the absorption efficiency caused by the coloring material aggregate 21 blocking up the solvent absorption holes 17B of the absorbing body 17, even if a solid droplet ejection image where dots are ejected so as to overlap with each other is formed.

Next, the material of the absorbing body 17 is described below. The absorbing body 17 may be formed by creating holes directly in the material used for the absorbing body 17, by means of a laser or another means. Moreover, it is also possible to use a porous body such as ceramic or silica, or a cloth of woven fibers, or the like, for the absorbing body 17.

By using a porous body for the absorbing body 17, the durability of the absorbing body 17 can be improved, and by using a fiber-based material for the absorbing body 17, the absorbing body 17 can be manufactured cheaply. It is desirable to select whether to use a porous body or a fiber-based material for the absorbing body 17, as appropriate, in accordance with the specifications of the apparatus.

Here, as shown in FIG. 4A, if the holes are formed in the absorbing body 17 directly by means of a laser, or the like, then the opening diameter D of the contact section 17A of the absorbing body 17 is defined as the diameter of these holes. Furthermore, if a porous body is used as the absorbing body 17, then it is possible to use a commonly known pore diameter distribution measurement apparatus (porosimeter) and desirably, the opening diameter is determined by means of a mercury intrusion technique (mercury intrusion porosity test). Moreover, as shown in FIG. 4B, if the opening does not have a substantially circular shape, as in the case of a fiber-based material, then desirably, the diameter of the circumscribed circle of the opening is defined as the opening diameter D.

The description above relates to the opening diameter D of the solvent absorption hole 17B with the contact section 17A of the absorbing body 17. The opening diameter in the parts other than the contact section (the inner side of the absorbing body and the opposite side to the contact section) does not have to be equal to or greater than the diameter of the coloring material aggregate 21 and it can be set to any desired size. Preferably, the opening diameter on the inner side of the absorbing body 17 is greater than the opening diameter in the contact section 17A, since this has the beneficial effect of accelerating the speed of absorption into the central portion of the absorbing body 17.

Furthermore, the solvent 23 absorbed by the absorbing body 17 is recovered from the absorbing body 17 by means of a solvent recovery device, thereby allowing the absorbing body 17 to be used repeatedly. More specifically, there is a method in which, when the absorbing body 17 has absorbed the solvent 23, it is placed in contact with another member (a recovery member) and the solvent 23 is moved from the absorbing body 17 to the recovery member, whereupon the recovery member is squeezed by means of a pressurizing roller or an elastic blade, or the like. Furthermore, it is also possible to replace the absorbing body 17 itself, once it has absorbed a prescribed amount of the solvent 23, rather than providing a solvent recovery device.

Description of Treatment Liquid and Ink

Here, the ink 27 used may be, for example, a dye-based ink in which a coloring material is dissolved in a liquid solvent in a molecular state (or an ion state), or a pigment-based ink in which a coloring material is dispersed in a liquid solvent in a state of very fine lumps, or the like.

On the other hand, the treatment liquid 28 is a liquid which generates an aggregate of the coloring material when mixed with the ink 27. More specifically, it is a treatment liquid 28 which precipitates or insolubilizes the coloring material in the ink by reacting with the ink 27, or a treatment liquid 28 which generates a semi-solid substance (gel) containing the coloring material in the ink by reacting with the ink 27.

The means for inciting a reaction between the ink 27 and the treatment liquid 28 may be based on: a method where an anionic coloring material in the ink is caused to react with a cationic compound in the treatment liquid; a method where the pH of the ink 27 is changed by mixing the ink 27 and the treatment liquid 28 of mutually different pH values, thereby causing the pigment to aggregate by breaking down the dispersion of the pigment in the ink; and a method where the pigment is caused to aggregate by breaking down the dispersion of the pigment in the ink by reaction with a polyvalent metal salt in the treatment liquid.

Treatment Liquid Deposition Method

Figure 7A:
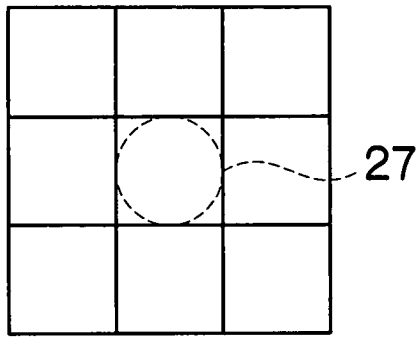
FIGS. 7A to 7E are diagrams showing specifications of a droplet ejection region for the treatment liquid.

The method of depositing the treatment liquid 28 may be a method where the intermediate transfer body 15 or recording paper 16 is coated with the treatment liquid 28 uniformly, regardless of the ejection of droplets of the ink 27, but a desirable mode is one which ejects droplets of the treatment liquid 28 from a head, similarly to the ink 27, since this allows reduction in the amount of treatment liquid 28 used. In this case, desirably, the region in which droplets of the treatment liquid 28 are ejected is made larger than the logical sum of a droplet ejection pattern of each of the colors of ink 27 (for example, C, M, Y and K in the case of a four-color image). FIGS. 7A to 7E are diagrams showing the specification of the droplet ejection region for the treatment liquid 28. For example, it shall be supposed that a dot of the ink 27 is ejected according to a droplet ejection pattern onto a pixel as shown in FIG. 7A, by the ink droplet ejection device.

Figure 7B:
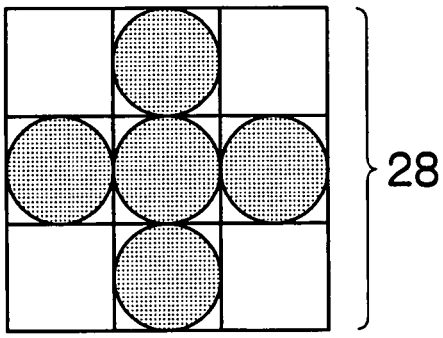
Figure 7D:
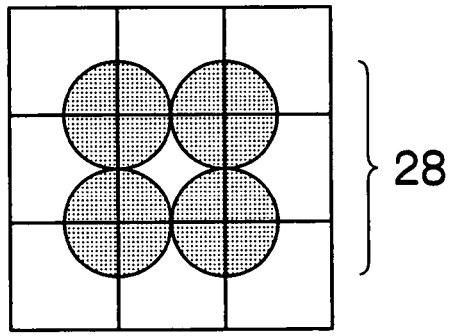
Figure 7C:
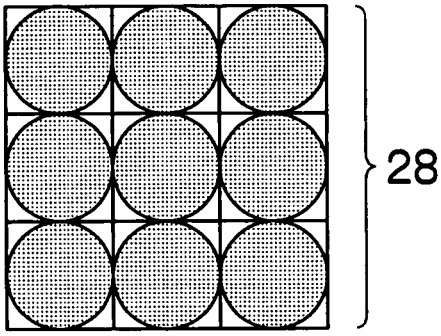
Figure 7E:
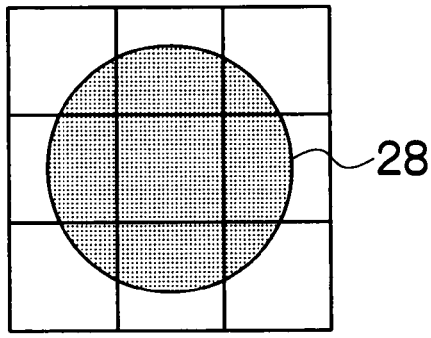

In this case, as shown in FIG. 7B, the specifications for ejecting droplets of the treatment liquid 28 are taken to include the pixels to the upper, lower and right and left-hand sides of the pixel where the droplet of ink 27 is ejected, in addition to that pixel. Furthermore, as shown in FIG. 7C, it is also possible to set the specifications whereby droplets of the treatment liquid 28 are ejected onto all of the pixels positioned to the upper, lower, right and left-hand sides, as well the pixels positioned in diagonal directions from the pixel where the droplet of ink 27 is ejected, in addition to that pixel. Moreover, as shown in FIG. 7D, it is also possible to adopt specifications whereby four droplets of the treatment liquid 28 are ejected to the upper, lower, left-hand and right-hand sides of the pixel where the droplet of ink 27 is ejected, at positions which are respectively staggered by half a pixel with respect to the pixel of ink 27. Furthermore, as shown in FIG. 7E, it is also possible to adopt the specifications whereby the droplet ejection region of the treatment liquid 28 is enlarged to reach outside the pixel where the droplet of ink 27 is ejected, while being centered on the pixel where the droplet of ink 27 is ejected, by making the dot diameter of the treatment liquid 28 larger than the dot diameter of the ink 27.

By setting the droplet ejection region of the treatment liquid 28 as shown in FIGS. 7A to 7E described above, it is possible to make all of the ink 27 react with the treatment liquid 28.

Figure 8A:
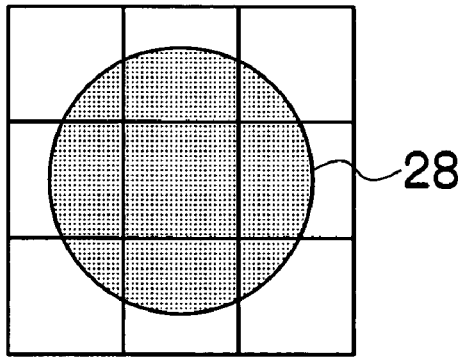
FIGS. 8A to 8C are drawings showing a combined dot formed by the treatment liquid dots.
Figure 8B:
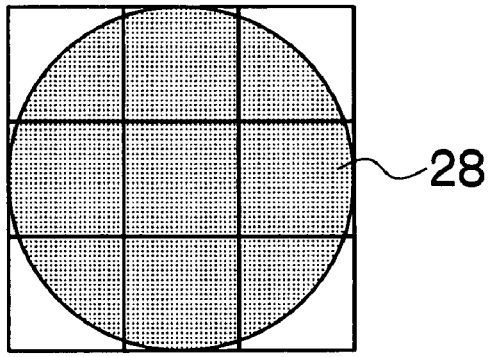
Figure 8C:
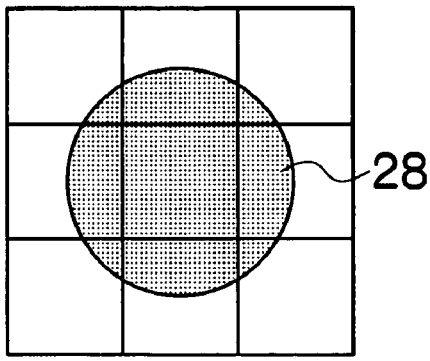

If the droplet ejection specifications for the treatment liquid 28 shown in FIG. 7B, 7C or 7D are adopted, then it is expected that the dots of treatment liquid 28 combine with each other and can ultimately form one substantially circular dot, as shown in FIGS. 8A to 8C. FIGS. 8A to 8C are diagrams of the combined dot formed by dots of the treatment liquid 28 which have unified into one substantially circular dot; FIG. 8A shows a case where droplets of the treatment liquid 28 are ejected as shown in FIG. 7B; FIG. 8B shows a case where droplets of the treatment liquid 28 are ejected as shown in FIG. 7C; and FIG. 8C shows a case where droplets of the treatment liquid 28 are ejected as shown in FIG. 7D.

In this case, considering a case where the mixed liquid of the ink 27 and treatment liquid 28 similarly forms a substantially circular shape at the end of the aggregation reaction of the coloring material 37, then it is desirable that the opening diameter D in the absorbing body 17 should be set to a smaller dimension than the diameter d2 of the mixed liquid at the end of the aggregation reaction of the coloring material 37. The reasons for this are described hereinafter.

Figure 9A:
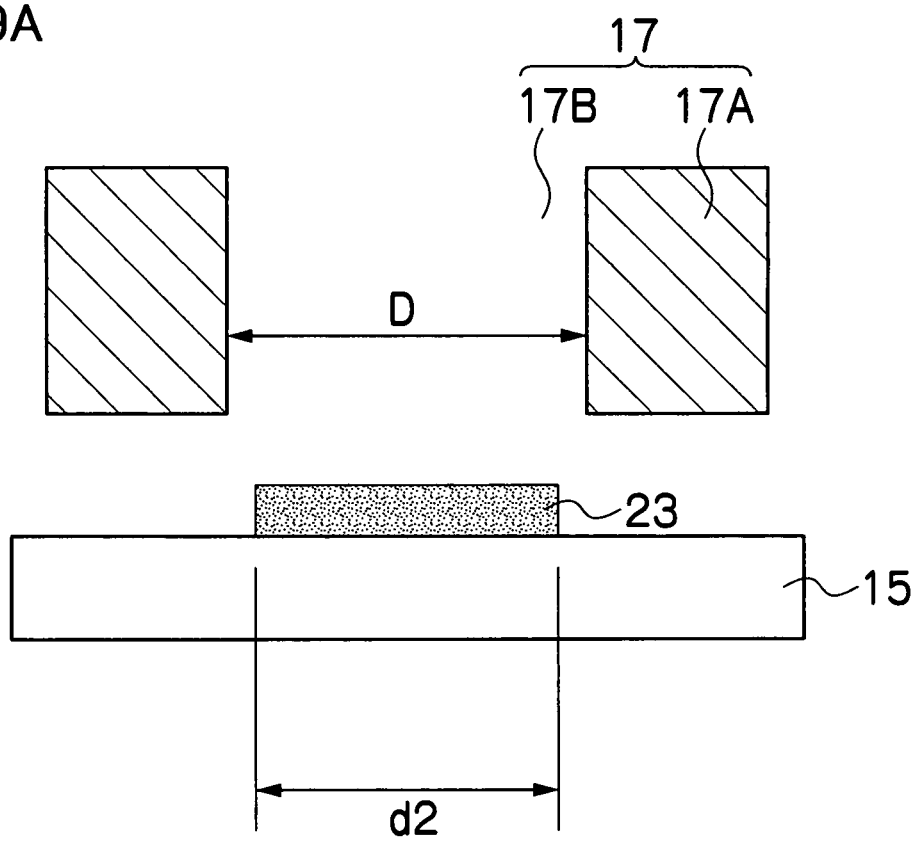
FIGS. 9A and 9B are diagrams showing a case where the opening diameter of the absorbing body is set to be greater than the diameter of the mixed liquid.
Figure 9B:
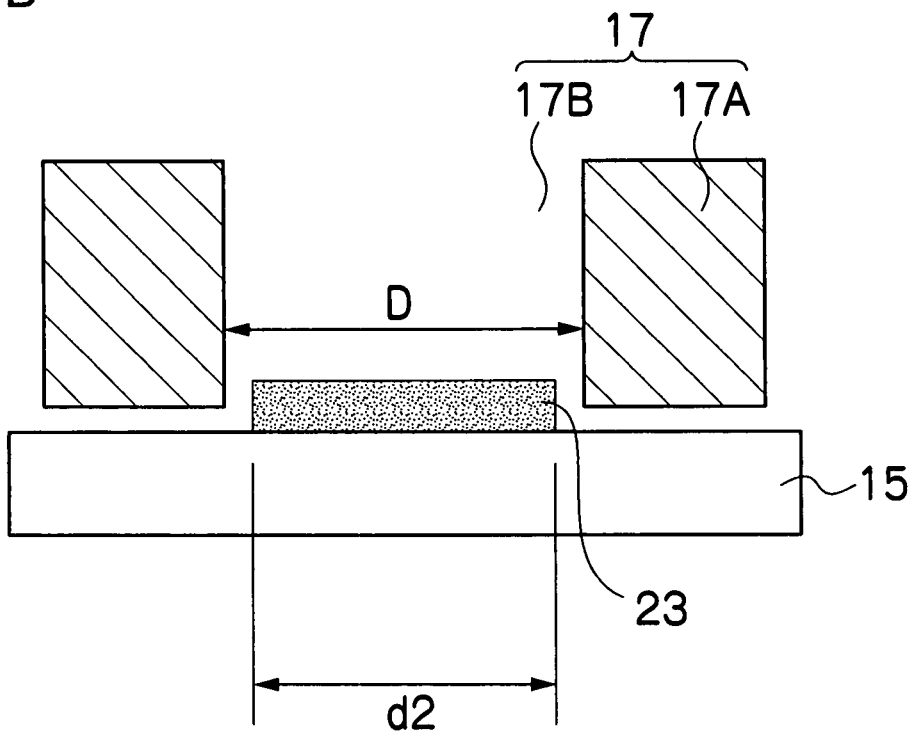
Figure 10A:
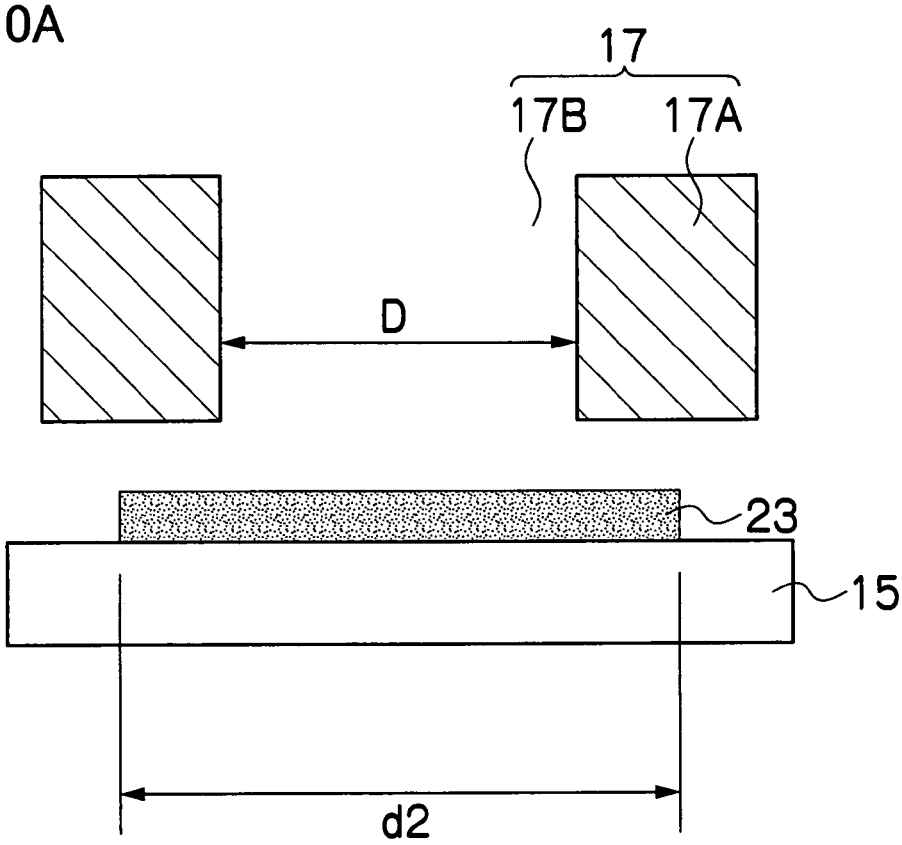
FIGS. 10A and 10B are diagrams showing a case where the opening diameter of the absorbing body is set to be smaller than the diameter of the mixed liquid.
Figure 10B:
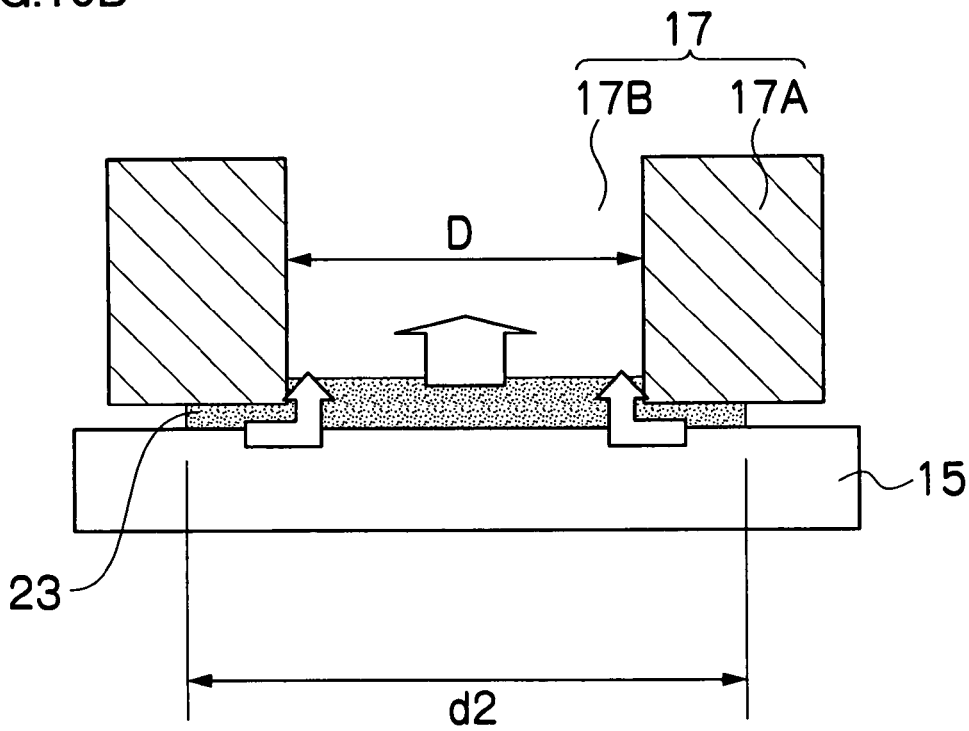

FIGS. 9A and 9B are diagrams showing a case where the opening diameter D of the absorbing body 17 is set to be larger than the diameter d2 of the mixed liquid; FIG. 9A shows a state before the absorbing body 17 is brought into close proximity with the intermediate transfer body 15 (or recording paper 16), and FIG. 9B shows a state after the absorbing body 17 has been brought into close proximity with the intermediate transfer body 15 (or recording paper 16). On the other hand, FIGS. 10A and 10B are diagrams showing a case where the opening diameter D in the absorbing body 17 is set to be smaller than the diameter d2 of the mixed liquid. FIG. 10A shows a state before the absorbing body 17 is brought into close proximity with the intermediate transfer body 15 (or the recording paper 16) and FIG. 10B shows a state after the absorbing body 17 has been brought into close proximity with the intermediate transfer body 15 (or the recording paper 16). In order to simplify the illustration, the coloring material aggregate 21 is not depicted in FIGS. 9A and 9B and FIGS. 10A and 10B.

As shown in FIG. 9B, if the opening diameter D of the absorbing body 17 is set to a larger dimension than the diameter d2 of the mixed liquid, then there is a possibility that a situation may arise where the solvent 23 of the mixed liquid does not make contact with the absorbing body 17. Consequently, there is a possibility that no capillary action may act on the solvent 23 and it may not be possible for the solvent 23 to be absorbed into the absorbing body 17 from the intermediate transfer body 15 (or the recording paper 16).

On the other hand, as shown in FIG. 10B, if the opening diameter D of the absorbing body 17 is set to a smaller dimension than the diameter d2 of the mixed liquid, then the solvent 23 always makes contact with the absorbing body 17. Therefore, it is possible to absorb the solvent 23 reliably from the intermediate transfer body 15 (or recording paper 16) into the absorbing body 17.

Consequently, it is desirable that the opening diameter D of the absorbing body 17 should be set to a smaller dimension than the diameter d2 of the mixed liquid.

In the present embodiment, the diameter d2 indicating the spreading width of the solvent 23 of the mixed liquid on the surface of the intermediate transfer body 15 (or the recording paper 16) is the width supposing that the coloring mixed liquid has assumed a substantially round shape at the time that the aggregation reaction of the coloring material 37 ends. However, since the shape of the mixed liquid is not limited to being a substantially round shape, then the spreading width of the solvent 23 of the mixed liquid on the surface of the intermediate transfer body 15 (or the recording paper 16) is taken to be the minimum width of the planar region occupied by the mixed liquid due to spreading, at the end of the aggregating reaction of the coloring material 37 on the surface of the intermediate transfer body 15 (or the recording paper 16).

Therefore, if the shape of the planar region in which the mixed liquid has spread is substantially elliptical, then the shorter diameter is regarded as the spreading width of the solvent 23 of the mixed liquid, and if it has a shape which cannot be specified as substantially circular or substantially elliptical, then the minimum width thereof is regarded as the spreading width of the solvent 23 of the mixed liquid.

Structure of the Head

Next, the structure of a head will be described. Next, the structure of the ink heads 12K, 12C, 12M and 12Y of the respective colors will be described. The ink heads 12K, 12C, 12M and 12Y of the respective colors have the same structure, and a reference numeral 50 is hereinafter designated to a representative example of these heads.

Figure 11A:
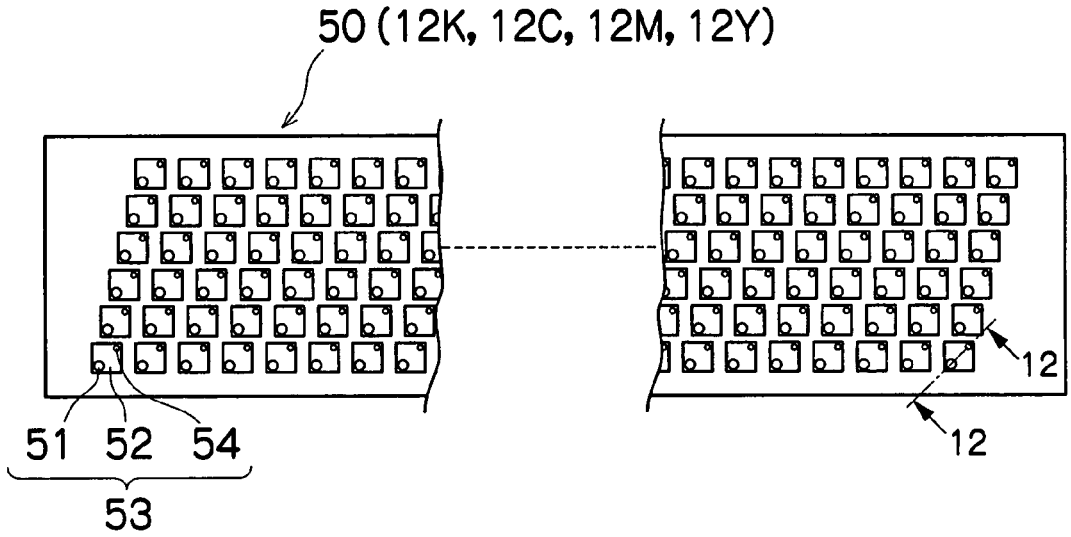
FIGS. 11A to 11C are plan view perspective diagrams showing examples of the structure of a head.
Figure 11B:
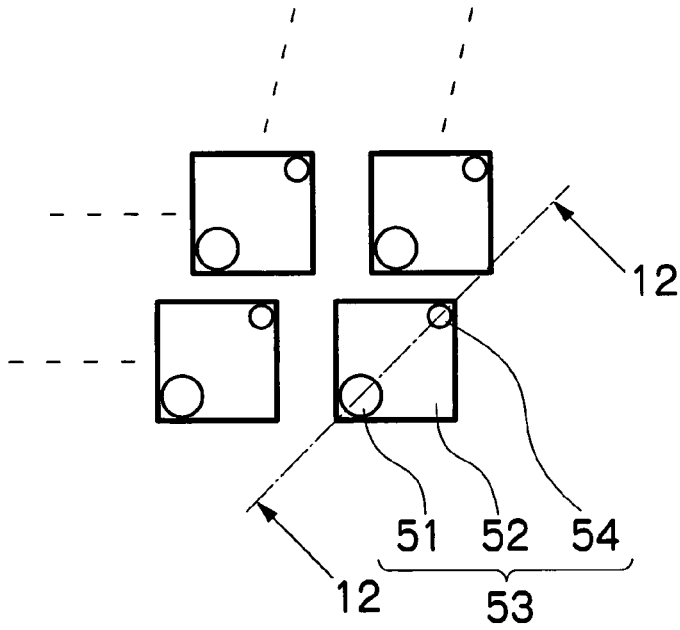
Figure 11C:
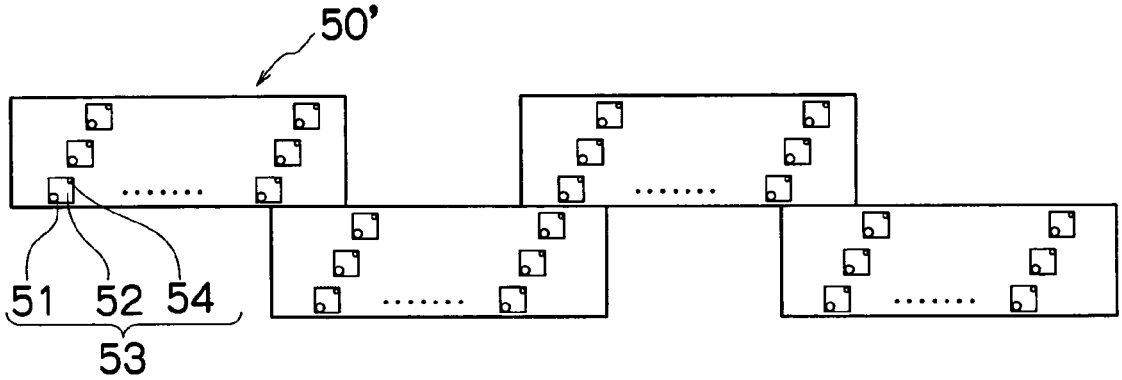
Figure 12:
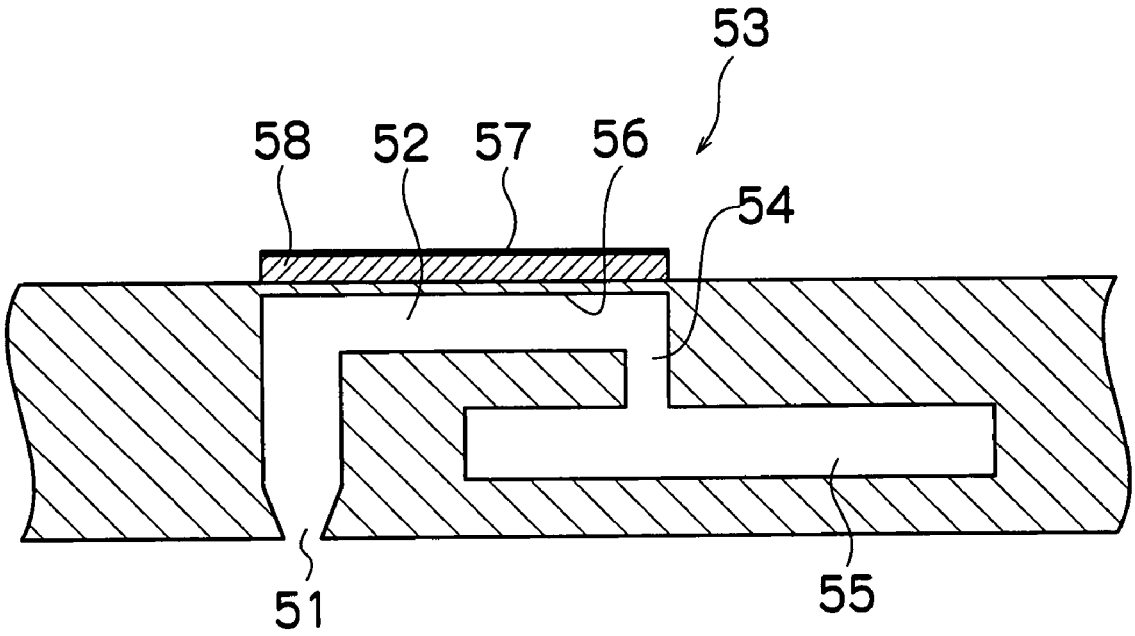
FIG. 12 is a cross-sectional view along line 12-12 in FIG. 11A.

FIG. 11A is a plan view perspective diagram showing an example of the structure of the ink head 50; FIG. 11B is an enlarged view of a portion of same; and FIG. 11C is a plan view perspective diagram showing a further example of the structure of the ink head 50. FIG. 12 is a cross-sectional diagram (along line 12-12 in FIGS. 11A and 11B) showing the three-dimensional composition of one of the liquid droplet ejection elements (an ink chamber unit corresponding to one nozzle 51).

In order to achieve a high density of the dot pitch printed onto the surface of the recording paper 16, it is necessary to achieve a high density of the nozzle pitch in the ink head 50. As shown in FIGS. 11A and 11B, the ink head 50 according to the present example has a structure in which a plurality of ink chamber units (liquid droplet ejection elements) 52, each including a nozzle 51 forming an ink ejection port, a pressure chamber 53 corresponding to the nozzle 51, and the like, are disposed (two-dimensionally) in the form of a staggered matrix, and hence the effective nozzle interval (the projected nozzle pitch) as projected in the lengthwise direction of the head (the direction perpendicular to the paper conveyance direction) is reduced (high nozzle density is achieved).

The mode of forming one or more nozzle rows through a length corresponding to the entire width of the recording paper 16 in a direction substantially orthogonal to the conveyance direction of the recording paper 16 is not limited to the example described here. For example, instead of the composition in FIG. 11A, as shown in FIG. 11C, a line head having nozzle rows of a length corresponding to the entire width of the recording paper 16 can be formed by arranging and combining, in a staggered matrix configuration, short head modules 50' each having a plurality of nozzles 51 arrayed in a two-dimensional fashion.

As shown in FIGS. 11A and 11B, the planar shape of the pressure chamber 52 provided corresponding to each nozzle 51 is substantially a square shape, and an outlet port to the nozzle 51 is provided at one of the ends of a diagonal line of the planar shape, while an inlet port (supply port) 54 for supplying ink is provided at the other end thereof. The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 12, each pressure chamber 52 is connected to a common flow passage 55 via the supply port 54. The common flow channel 55 is connected to an ink tank (not shown), which is a base tank that supplies ink, and the ink 27 supplied from the ink tank is delivered through the common flow channel 55 to the pressure chambers 52.

A bending mode is used as the method for pressurizing the pressure chambers 52, and an actuator 58 comprising an individual electrode 57 is bonded to a pressurization plate 56 (a diaphragm which also serves as a common electrode) that constitutes a portion of the surfaces of the pressure chamber 52 (in FIG. 12, it constitutes the ceiling surface). When a drive voltage is applied to the individual electrode 57 and the common electrode, the actuator 58 deforms, thereby changing the volume of the pressure chamber 52. This causes a pressure change which results in ink 27 being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink 27, the pressure chamber 52 is replenished with new ink 27 from the common flow channel 55 via the supply port 54.

Figure 13:
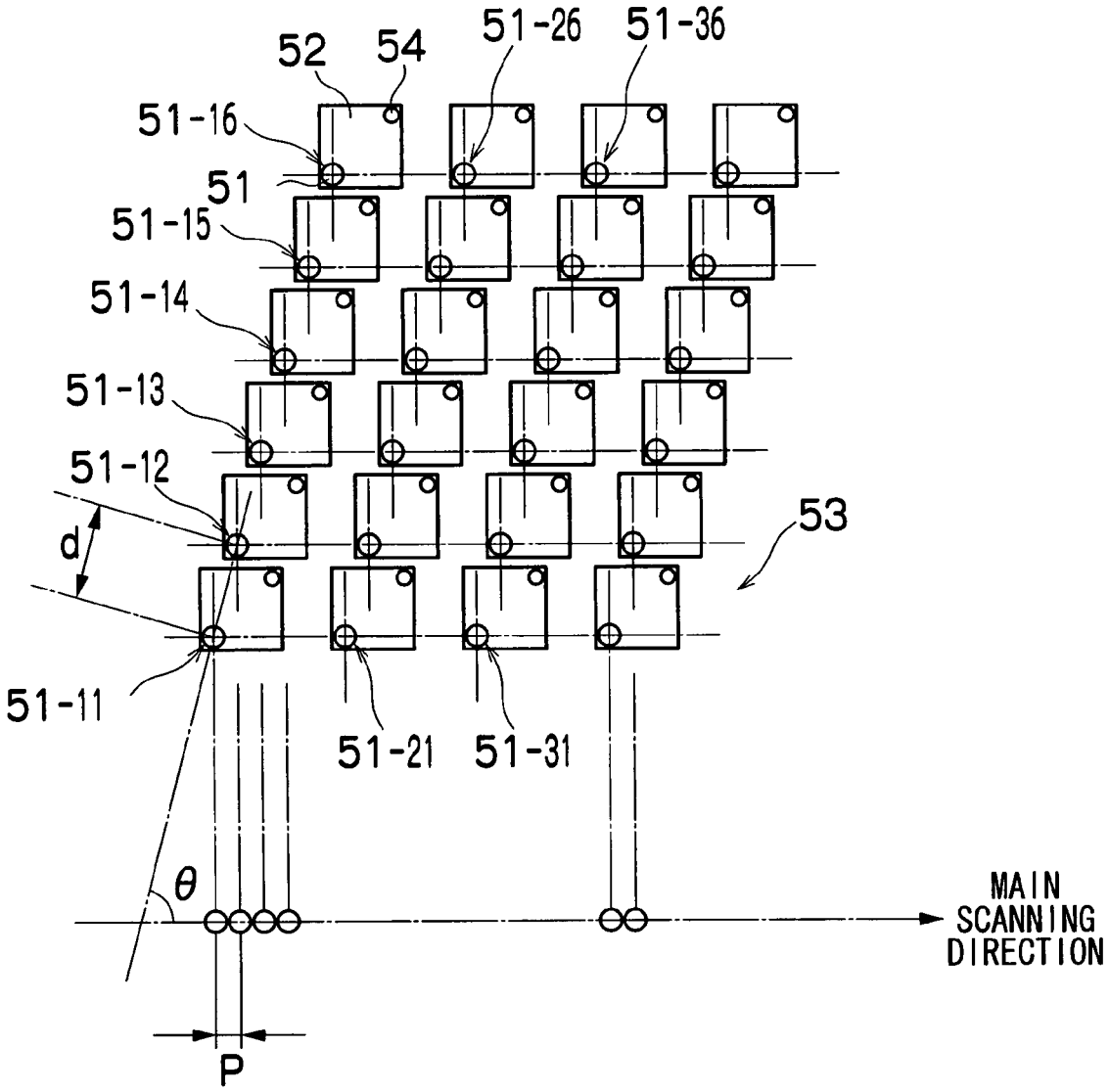
FIG. 13 is an enlarged diagram showing a nozzle arrangement in a head.

As shown in FIG. 13, the high-density nozzle head according to the present embodiment is achieved by composing a plurality of ink chamber units 53 having this structure in a lattice arrangement, based on a fixed arrangement pattern having a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected to an alignment in the main scanning direction is $d \times \cos\theta$, and hence it is possible to treat the nozzles 51 as if they were arranged linearly at a uniform pitch of P. By means of this composition, it is possible to achieve a nozzle composition of high density, in which the nozzle columns projected to an alignment in the main scanning direction reach a total of 2400 per inch (2400 nozzles per inch).

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix configuration such as that shown in FIG. 13 are driven, it is desirable that main scanning is performed in accordance with (3) described above. In other words, taking the nozzles 51-11, 51-12, 51-13, 51-14, 51-15 and 51-16 as one block (and furthermore, taking nozzles 51-21, . . . , 51-26 as one block, and nozzles 51-31, . . . , 51-36 as one block), one line is printed in the breadthways direction of the recording paper 16 by sequentially driving the nozzles 51-11, 51-12, . . . , 51-16 in accordance with the conveyance speed of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 16 is called the sub-scanning direction and the direction perpendicular to same is called the main scanning direction. In implementing the present invention, the arrangement of the nozzles is not limited to that of the example illustrated.

Composition of Inkjet Recording Apparatus

Next, the inkjet recording apparatus according to the present embodiment will be described in detail. FIG. 1 is a general schematic drawing of an intermediate transfer type of inkjet recording apparatus which shows one embodiment of an inkjet recording apparatus according to the present invention. As shown in FIG. 1, this inkjet recording apparatus 10A comprises a treatment liquid head 11 which is provided to correspond to a treatment liquid 28, a treatment liquid storing and loading unit 13 for storing treatment liquid 28 to be supplied to the treatment liquid head 11, and a print unit 12 having a plurality of ink heads 12K, 12C, 12M and 12Y provided to correspond to respective inks 27 which contain respective coloring materials 37 of black (K), cyan (C), magenta (M) and yellow (Y). Furthermore, an absorbing body 17 for absorbing the solvent is provided. The inkjet recording apparatus also comprises a transfer mechanism constituted by an intermediate transfer body 15 having an endless shape which is spanned about a plurality of rollers (38 to 41), a transfer body cleaning unit 19 which cleans the intermediate transfer body 15, a belt conveyance unit 43, disposed facing the intermediate transfer body 15, which conveys the recording paper 16 while keeping the recording paper 16 flat, and rollers 39, 40, 46 and 48 which transfer the image formed on the intermediate transfer body 15 to recording paper 16 by applying pressure to the recording paper 16.

Desirably, the material of the intermediate transfer body 15 is a material whereby the adhesion energy between the intermediate transfer body 15 and the coloring material aggregate 21 is greater than the adhesion energy between the absorbing body 17 and the coloring material aggregate 21 (and consequently, the coloring material aggregate 21 does not adhere to the absorbing body 17 even if the absorbing body 17 and the coloring material aggregate 21 make contact), and is lower than the adhesion energy between the recording paper 16 and the coloring material aggregate 21 (and consequently, the coloring material aggregate 21 is transferred to the recording paper 16 when the recording paper 16 and the coloring material aggregate 21 make contact).

The belt conveyance unit 43 has a structure in which an endless belt 29 is wound between rollers 46, 47 and 48, and the recording paper 16 is supplied to this belt conveyance unit 43.

The belt 29 is driven in the clockwise direction in FIG. 1 by means of the motive force of a motor (not shown) being transmitted to at least one of the rollers 46, 47 and 48 about which the belt 29 is set, and the recording paper 16 held on the belt 29 is thereby conveyed from left to right in FIG. 1.

The treatment liquid head 11 and the ink heads 12K, 12M, 12C and 12Y of the print unit 12 are each full line heads having a length corresponding to the maximum width of the intermediate transfer body 15 used in the inkjet recording apparatus 10A, and comprising a plurality of nozzles for ejecting ink arranged on a nozzle face through a length exceeding at least one edge of the maximum-size recording paper (namely, the full width of the printable range).

The treatment liquid head 11 and the ink heads 12K, 12C, 12M and 12Y are arranged in the order of: treatment liquid 28, and ink 27 of black (K), cyan (C), magenta (M), yellow (Y), from the upstream side in the delivery direction of the recording paper 15, and the treatment liquid head 11 and the ink heads 12K, 12C, 12M and 12Y are fixed extending in a direction substantially perpendicular to the conveyance direction of the intermediate transfer body 15.

After firstly ejecting the treatment liquid 28 from the treatment liquid head 11 while conveying the intermediate transfer body 15, a color image is formed by the coloring material aggregate 21 on the intermediate transfer body 15 by ejecting inks 27 of different colors respectively from the ink heads 12K, 12C, 12M and 12Y. Thereupon, the solvent 23 of the treatment liquid 28 and the ink 27 is removed by the absorbing body 17, and the coloring material aggregate 21 on the intermediate transfer body 15 is transferred to the recording paper 16 conveyed by the belt conveyance unit 43, whereby a color image can be formed on the recording paper 16.

In this way, by adopting a configuration in which full line ink heads 12K, 12C, 12M and 12Y, each having nozzle rows covering the full width of the recording paper on which an image is ultimately formed by transfer, are provided for respective separate colors in this way, it is possible to record an image on the full surface of the recording paper 16 by performing just one operation of moving the intermediate transfer body 15 and the print unit 12, relatively, in the paper conveyance direction (in other words, by means of one sub-scanning action). Higher-speed printing is thereby made possible and productivity can be improved in comparison with a shuttle type head configuration in which a recording head reciprocates in the main scanning direction.

Furthermore, FIG. 2 is a general schematic drawing of a direct printing type of inkjet recording apparatus showing a further embodiment of an inkjet recording apparatus relating to the present invention. As shown in FIG. 2, this inkjet recording apparatus 10B comprises: a treatment liquid head 11 provided to correspond to a treatment liquid 28 which does not contain coloring material 37; a treatment liquid storing and loading unit 13 which stores the treatment liquid 28 to be supplied to the treatment liquid head 11; a print unit 12 having a plurality of ink heads 12K, 12C, 12M and 12Y provided to correspond to respective inks 27 containing respective coloring materials of black (K), cyan (C), magenta (M) and yellow (Y); an ink storing and loading unit 14 for loading the inks 27 to be supplied to the respective ink heads 12K, 12C, 12M and 12Y; an absorbing body 17 for absorbing the solvent; a paper supply unit 18 for supplying recording paper 16 forming a recording medium; a decurling unit 20 for removing curl from the recording paper 16; a belt conveyance unit 22, disposed facing the nozzle surface (ink ejection surface) of the print unit 12, which conveys the recording paper 16 while keeping the recording paper 16 flat; a print determination unit 24 which reads in the print results obtained by the print unit 12; and a paper output unit 26 which outputs the recorded paper (printed matter) to the exterior.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine.

In the case of the configuration in which roll paper is used, a cutter (first cutter) 45 is provided as shown in FIG. 2, and the continuous paper is cut into a desired size by the cutter 45.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 2. The suction chamber 34 provides suction with a fan 35 to generate a negative pressure, and the recording paper 16 is held on the belt 33 by suction.

The belt 33 is driven in the clockwise direction in FIG. 2 by the motive force of a motor being transmitted to at least one of the rollers 31 and 32, which the belt 33 is set around, and the recording paper 16 held on the belt 33 is conveyed from left to right in FIG. 2.

Since the ink 27 adheres to the belt 33 when a marginless print job or the like is performed, a belt-cleaning unit 36 is disposed in a predetermined position (a suitable position outside the printing area) on the exterior side of the belt 33. A heating fan 42 is disposed on the upstream side of the print unit 12 in the conveyance pathway formed by the belt conveyance unit 22. The heating fan 42 blows heated air onto the recording paper 16 to heat the recording paper 16 immediately before printing so that the ink 27 deposited on the recording paper 16 dries more easily.

These respective ink heads 12K, 12C, 12M and 12Y of the treatment liquid head 11 and the print unit 12 are full line heads having a length corresponding to the maximum width of the recording paper 16 used with the inkjet recording apparatus 10B, and comprising a plurality of nozzles for ejecting ink arranged on a nozzle face through a length exceeding at least one edge of the maximum-size recording paper (namely, the full width of the printable range).

The treatment liquid head 11 and these respective ink heads 12K, 12C, 12M and 12Y are arranged in the order of the treatment liquid 28 and ink 27 of color order (black (K), cyan (C), magenta (M), yellow (Y)) from the upstream side in the feed direction of the recording paper 16, and these treatment liquid head 11 and ink heads 12K, 12C, 12M and 12Y are fixed extending in a direction substantially perpendicular to the conveyance direction of the recording paper 16.

A color image can be formed on the recording paper 16 by ejecting the treatment liquid 28 and the inks 27 of different colors from the treatment liquid head 11 and the these heads 12K, 12C, 12M and 12Y, respectively, onto the recording paper 16 while the recording paper 16 is conveyed by the belt conveyance unit 22.

By adopting a configuration in which the full line ink heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

The print determination unit 24 illustrated in FIG. 2 has an image sensor (line sensor or area sensor) for capturing an image of the droplet ejection result of the print unit 12, and functions as a device to check the ejection characteristics, such as blockages, landing position error, and the like, of the nozzles, on the basis of the image of ejected droplets read in by the image sensor.

A CCD area sensor in which a plurality of photoreceptor elements (photoelectric transducers) are two-dimensionally arranged on the light receiving surface is suitable for use as the print determination unit 24 of the present example.

The printed matter generated in this manner is outputted from the paper output unit 26. The target print (i.e., the result of printing the target image) and the test print are preferably outputted separately. In the inkjet recording apparatus 10B, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 49. Although not shown in FIG. 1, the paper output unit 26A for the target prints is provided with a sorter for collecting prints according to print orders.

Description of Control System

Figure 14:
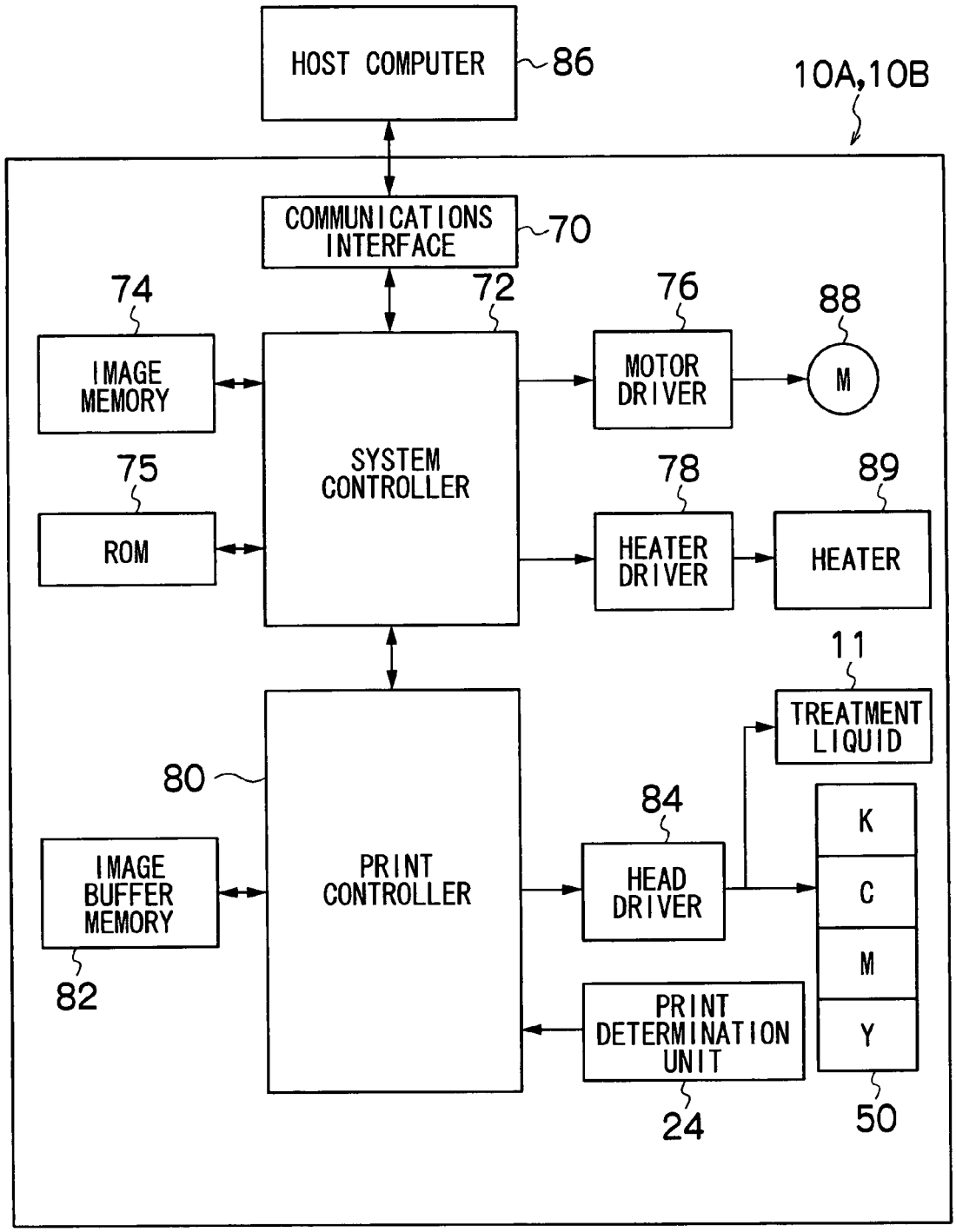
FIG. 14 is a block diagram showing a system composition of the inkjet recording apparatus.

FIG. 14 is a principal block diagram showing the system configuration of the inkjet recording apparatuses 10A and 10B. As shown in FIG. 14, the inkjet recording apparatuses 10A and 10B comprises a communication interface 70, a system controller 72, an image memory 74, a ROM 75, a motor driver 76, a heater driver 78, a print controller 80, an image buffer memory 82, a head driver 84, and the like.

The communications interface 70 is an interface unit (image input unit) which functions as an image input device for receiving image data transmitted by a host computer 86. A serial interface such as USB (Universal Serial Bus), IEEE1394, Ethernet (registered trademark), wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatuses 10A and 10B through the communication interface 70, and is temporarily stored in the image memory 74. The image memory 74 is a storage device storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatuses 10A and 10B in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 of the conveyance system and the heater 89.

The program executed by the CPU of the system controller 72 and the various types of data which are required for control procedures (including measurement test pattern data such as landing position errors) are stored in the ROM 75. The ROM 75 may be a non-rewritable storage device, or it may be a rewriteable storage device, such as an EEPROM.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the heating fan 42 or the like in accordance with commands from the system controller 72.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the ink head 50 by supplying the ink ejection data thus generated to the head driver 84.

An image buffer memory 82 is provided with the print controller 80, and image data, parameters, and other data are temporarily stored in the image buffer memory 82 when image data is processed in the print controller 80. FIG. 14 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source via a communications interface 70, and is accumulated in the image memory 74. At this stage, multiple-value RGB image data is stored in the image memory 74, for example.

In these inkjet recording apparatuses 10A and 10B, an image which appears to have continuous tonal graduations to the human eye is formed by changing the droplet ejection density and the dot size of fine dots created by the inks 27 (coloring material), and therefore, it is necessary to convert the input digital image into a dot pattern which reproduces the tonal graduations of the image (namely, the light and shade toning of the image) as faithfully as possible. Therefore, the original image data (RGB data) stored in the image memory 74 is sent to the print controller 80 through the system controller 72, and is converted into dot data for each ink color.

In other words, the print controller 80 performs processing for converting the input RGB image data into dot data for the four colors of K, C, M and Y. The dot data generated by the print controller 80 in this way is stored in the image buffer memory 82. This dot data for the respective colors is converted into CMYK droplet ejection data for ejecting the inks 27 from the nozzles of the ink heads 50, thereby establishing the ink ejection data to be printed. Furthermore, dot data for the treatment liquid 28 is generated on the basis of this color-specific dot data, by means of the technique described above.

The head driver 84 outputs drive signals for driving the actuators 58 corresponding to the nozzles 51 of the ink heads 50 and the treatment liquid head 11 in accordance with the print contents, on the basis of the ink ejection data and the drive waveform signals supplied by the print controller 80. A feedback control system for maintaining constant drive conditions for the heads may be included in the head driver 84.

By supplying the drive signals output by the head driver 84 to the ink heads 50 or the treatment liquid head 11 in this way, the inks 27 and treatment liquid 28 are ejected from the corresponding nozzles 51. By controlling ink ejection from the ink heads 50 and the treatment liquid head 11 in synchronism with the conveyance speed of the intermediate transfer body 15 (or the recording paper 16), an image is formed on the intermediate transfer body 15 (or the recording paper 16).

The ejection volume and the ejection timing of the droplets of ink 27 and treatment liquid 28 from the respective nozzles are controlled via the head driver 84, on the basis of the ink 27 and treatment liquid 28 ejection data and drive signal waveforms generated by implementing prescribed signal processing in the print controller 80 as described above. By this means, desired dot sizes and dot positions can be achieved.

The print determination unit 24 is a block that includes the image sensor as described above with reference to FIG. 2, reads the image printed on the recording paper 16, determines the print conditions (presence of the ejection, variation in the dot formation, optical density and the like) by performing required signal processing, or the like, and provides the determination results of the print conditions to the print controller 80 and the system controller 72.

The print controller 80 implements various corrections with respect to the ink heads 50, on the basis of the information obtained from the print determination unit 24, according to requirements, and it implements control for carrying out cleaning operations (nozzle restoring operations), such as preliminary ejection, suctioning, or wiping, as and when necessary.

Inkjet recording apparatuses according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an ink droplet ejection device which ejects and deposits a droplet of an ink containing a coloring material onto an ink droplet deposition position on a surface of a recording body;

a treatment liquid deposition device which ejects and deposits a droplet of a treatment liquid onto a treatment liquid droplet deposition position on the surface of the recording body, the deposited treatment liquid and the deposited ink reacting with each other to cause the coloring material contained in the deposited ink to aggregate so as to produce a mixture of a solvent and a coloring material aggregate on the surface of the recording body, the coloring material aggregate having a greater specific weight than the solvent and being not dissolved and not dispersed in the solvent; and an absorbing body which absorbs the solvent in the mixture having been produced on the surface of the recording body through solvent absorption holes arranged in a surface of the absorbing body, wherein when the surface of the absorbing, body makes contact with the mixture having been produced for one isolated droplet of the ink on the surface of the recording body, an opening diameter of each of the solvent absorption holes is larger than a spreading width of the coloring material aggregate and smaller than a spreading width of the solvent which is larger than the spreading width of the coloring material aggregate.

2. The inkjet recording apparatus as defined in claim 1, wherein the droplet of the ink is ejected and deposited by the ink droplet ejection device onto the ink droplet deposition position on the surface of the recording body after the droplet of the treatment liquid is ejected and deposited by the treatment liquid deposition device onto the treatment liquid droplet deposition position on the surface of the recording body.

3. The inkjet recording apparatus as defined in claim 1, wherein:

the recording body is an intermediate transfer body on which the coloring material aggregate in the mixture forms an image being transferred to a recording medium from the intermediate transfer body; and the absorbing body absorbs the solvent in the mixture on the intermediate transfer body.

4. An inkjet recording method comprising the steps of:

ejecting and depositing a droplet of a treatment liquid onto a treatment liquid droplet deposition position on a surface of a recording body;

ejecting and depositing a droplet of an ink containing a coloring material onto an ink droplet deposition position on the surface of the recording body, the deposited treatment liquid and the deposited ink reacting with each other to cause the coloring material contained in the deposited ink to aggregate so as to produce a mixture of a solvent and a coloring material aggregate on the surface of the recording body, the coloring material aggregate having a greater specific weight than the solvent and being not dissolved and not dispersed in the solvent;

and absorbing with an absorbing body the solvent in the mixture having been produced on the surface of the recording body through solvent absorption holes arranged in a surface of the absorbing body, wherein when the surface of the absorbing body makes contact with the mixture having been produced for one isolated droplet of the ink on the surface of the recording body, an opening diameter of each of the solvent absorption holes is larger than a spreading width of the coloring material aggregate and smaller than a spreading width of the solvent which is larger than the spreading width of the coloring material aggregate.

5. The inkjet recording apparatus as defined in claim 1, wherein the solvent absorption holes in the surface of the absorbing body are arranged at intervals substantially equidistant to a distance between the droplets of ink on the recording body.

6. The inkjet recording method as defined in claim 4, wherein in the surface of the absorbing body used in the absorbing step, the solvent absorption holes are arranged at intervals substantially equidistant to a distance between the spacing between coloring material aggregated on the recording body.

7. The inkjet recording method as defined in claim 4, wherein each of the solvent absorption holes has the opening diameter larger at an inner side of the absorbing body than at the surface of the absorbing body.

8. The inkjet recording method as defined in claim 4, wherein the step of ejecting and depositing the droplet of the ink is carried out after the step of ejecting and depositing the droplet of the treatment liquid.

9. The inkjet recording method as defined in claim 4, wherein:

the recording body is an intermediate transfer body on which the coloring material aggregate in the mixture forms an image;

in the absorbing step, the absorbing body absorbs the solvent in the mixture on the intermediate transfer body; and the inkjet recording method further comprises the step of transferring the image formed on the intermediate transfer body to a recording medium.

10. The inkjet recording method as defined in claim 4, wherein the treatment liquid droplet deposition position is at a same position with the ink droplet deposition position.

11. The inkjet recording method as defined in claim 4, wherein the treatment liquid droplet deposition position is a group of positions consisting of:

a position which is a same position with, the ink droplet deposition position;

a position which is shifted to an upper side by one pixel from the ink droplet deposition position;

a position which is shifted to a right side by one pixel from the ink droplet deposition position;

a position which is shifted to a lower side by one pixel from the ink droplet deposition position; and a position which is shifted to a left side by one pixel from the ink droplet deposition position.

12. The inkjet recording method as defined in claim 4, wherein the treatment liquid droplet deposition position is a group of positions consisting of:

a position which is a same position with the ink droplet deposition position;

a position which is shifted to an upper side by one pixel from the ink droplet deposition position;

a position which is shifted to an upper side by one pixel and to a right side by one pixel from the ink droplet deposition position;

a position which is shifted to a right side by one pixel from the ink droplet deposition position;

a position which is shifted to a lower side by one pixel and to a right side by one pixel from the ink droplet deposition position;

a position which is shifted to a lower side by one pixel from the ink droplet deposition position;

a position which is shifted to a lower side by one pixel and to a left side by one pixel from the ink droplet deposition position;

a position which is shifted to a left side by one pixel from the ink droplet deposition position; and a position which is shifted to an upper side by one pixel and to a left side by one pixel from the ink droplet deposition position.

13. The inkjet recording method as defined in claim 4, wherein the treatment liquid droplet deposition position is a group of positions consisting of:

a position which is shifted to an upper side by a half-pixel and to a right side by a half-pixel from the ink droplet deposition position;

a position which is shifted to a lower side by a half-pixel and to a right side by a half-pixel from the ink droplet deposition position;

a position which is shifted to a lower side by a half-pixel and to a left side by a half-pixel from the ink droplet deposition position; and a position which is shifted to an upper side by a half-pixel and to a left side by a half-pixel from the ink droplet deposition position.

14. The inkjet recording apparatus as defined in claim 1, wherein each of the solvent absorption holes has the opening diameter larger at an inner side of the absorbing body than at the surface of the absorbing body.

15. The inkjet recording apparatus as defined in claim 1, wherein the treatment liquid droplet deposition position is a position same with the ink droplet deposition position.

16. The inkjet recording apparatus as defined in claim 1, wherein the treatment liquid droplet deposition position is a group of positions consisting of:

a position which is at a same position with the ink droplet deposition position;

a position which is shifted to an upper side by one pixel from the ink droplet deposition position;

a position which is shifted to a right side by one pixel from the ink droplet deposition position;

a position which is shifted to a lower side by one pixel from the ink droplet deposition position; and a position which is shifted to a left side by one pixel from the ink droplet deposition position.

17. The inkjet recording apparatus as defined in claim 1, wherein the treatment liquid droplet deposition position is a group of positions consisting of:

a position which is a same position with the ink droplet deposition position;

a position which is shifted to an upper side by one pixel from the ink droplet deposition position;

a position which is shifted to an upper side by one pixel and to a right side by one pixel from the ink droplet deposition position;

a position which is shifted to a right side by one pixel from the ink droplet deposition position;

a position which is shifted to a lower side by one pixel and to a right side by one pixel from the ink droplet deposition position;

a position which is shifted to a lower side by one pixel from the ink droplet deposition position;

a position which is shifted to a lower side by one pixel and to a left side by one pixel from the ink droplet deposition position;

a position which is shifted to a left side by one pixel from the ink droplet deposition position; and a position which is shifted to an upper side by one pixel and to a left side by one pixel from the ink droplet deposition position.

18. The inkjet recording apparatus as defined in claim 1, wherein the treatment liquid droplet deposition position is a group of positions consisting of:

a position which is shifted to an upper side by a half-pixel and to a right side, by a half-pixel from the ink droplet deposition position;

a position which is shifted to a lower side by a half-pixel and to a right side by a half-pixel from the ink droplet deposition position;

a position which is shifted to a lower side by a half-pixel and to a left side by a half-pixel from the ink droplet deposition position; and a position which is shifted to an upper side by a half-pixel and to a left side by a half-pixel from the ink droplet deposition position.

* * * * *